United States Patent [19]

Nakatsuka

[11] Patent Number: 4,644,518

[45] Date of Patent: Feb. 17, 1987

[54] CIRCUIT CONNECTION FOR COILS WOUND ON YOKE OF AN ELECTROMAGNETIC PICKUP CARTRIDGE

[75] Inventor: Hisayoshi Nakatsuka, Mitaka, Japan

[73] Assignee: Namiki Precision Jewel Co., Ltd., Tokyo, Japan

[21] Appl. No.: 645,774

[22] Filed: Aug. 30, 1984

[30] Foreign Application Priority Data

Jan. 30, 1984 [JP] Japan ..... 59-12093[U]

[51] Int. Cl.[4] ..... H04R 11/12

[52] U.S. Cl. ..... 369/146

[58] Field of Search ..... 369/135, 136, 137, 138, 369/146, 147, 148, 256, 149

[56] References Cited

U.S. PATENT DOCUMENTS

| | | | |
|---|---|---|---|
| 3,526,728 | 9/1970 | Atsushi Iga | 369/136 |
| 4,072,823 | 2/1978 | Minamizono | 369/136 |
| 4,177,360 | 12/1979 | Fujimoto et al. | 369/136 |
| 4,345,322 | 8/1982 | Aizawa et al. | 369/148 |

FOREIGN PATENT DOCUMENTS

| | | | |
|---|---|---|---|
| 2365030 | 7/1975 | Fed. Rep. of Germany | 369/136 |
| 56-61895 | 5/1981 | Japan | 369/136 |

OTHER PUBLICATIONS

McProud, "The Stereo Phasing Problem", Audio, Sep., 1958, pp. 38+.

*Primary Examiner*—Donald McElheny, Jr.
*Attorney, Agent, or Firm*—Gerald J. Ferguson, Jr.; Michael P. Hoffman; Ronni S. Malamud

[57] ABSTRACT

An electromagnetic pickup cartridge having a pair of output terminals and a yoke with a pair of arms and a pair of generator coils respectively would on the arms where the first of the coils has a start terminal where the coil winding begins and an end terminal where the winding ends and the second of the coils also has a start terminal and an end terminal to thus provide a first pair of start terminals and a pair of end teminals where one of the pairs of terminals are connected to each other and the other of the pairs of terminals are respectively connected to the output terminals. In particular, the start terminals may be connected to each other while the end terminals are respectively connected to the output terminals or vice versa.

5 Claims, 3 Drawing Figures

CIRCUIT CONNECTION FOR COILS WOUND ON YOKE OF AN ELECTROMAGNETIC PICKUP CARTRIDGE

BACKGROUND OF THE INVENTION

1. Field of the Invention

This invention relates to an electromagnetic pickup cartridge and, in particular, to such a cartridge which may be of the moving magnet type having a generator coil wound on the arms of a magnetically permeable yoke.

2. Discussion of the Prior Art

As shown in FIG. 1, a moving magnet type pickup cartridge comprises cantilever unit 4 opposing a magnet 3, which is stabilized at the rear end of a cantilever 2. A record reproducing stylus 1 is mounted at the tip. A U-shaped yoke 5 is positioned so that magnet 3 is loosely inserted into the opening of the yoke. A pair of coils 6 and 6' are wound on yoke 5 where coil 6 includes a start terminal s at the beginning of the winding and an end terminal e at the end of the winding and coil 6' includes a start terminal s' and an end terminal e'. As can be seen in FIG. 1, the wound end terminal e of coil 6 is connected to terminal s' of winding 6' and the remaining terminals s and e' form one channel of the pickup cartridge output.

When the respective electrostatic capacities of coils 6 and 6' are compared as seen from yoke 5, it can be seen in FIG. 2 that the respective distributed capacities increase toward the wound ends e and e' in both 6 and 6' with respect to the direction of current flow. Consequently, this conventional series connection method causes electrostatic capacity between the yoke and the coils as seen from the output terminals of the cartridge to be unbalanced. Thus, transient characteristics deteriorate which is one reason the reproduced sound quality is lowered.

SUMMARY OF THE INVENTION

A primary object of the invention is to balance the electrostatic capacity occurring between the yoke and the coils in a pickup cartridge of the above general type.

Other objects and advantages of this invention will be apparent from a reading of the following specification and claims taken with the drawing.

DETAILED DESCRIPTION OF PREFERRED EMBODIMENTS OF THE INVENTION

Figure 1:
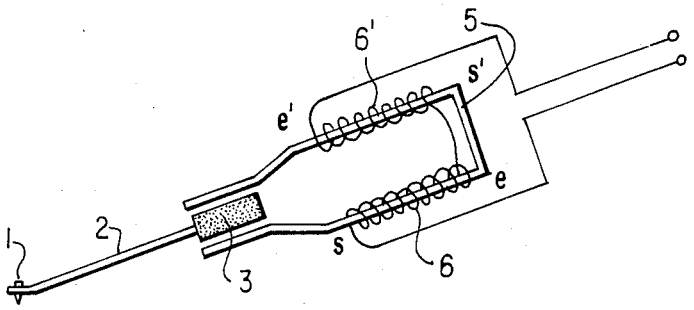
FIG. 1 (PRIOR ART)
FIG. 1 is a cross-sectional diagram of a moving magnet type pickup cartridge of the prior art.
Figure 2:
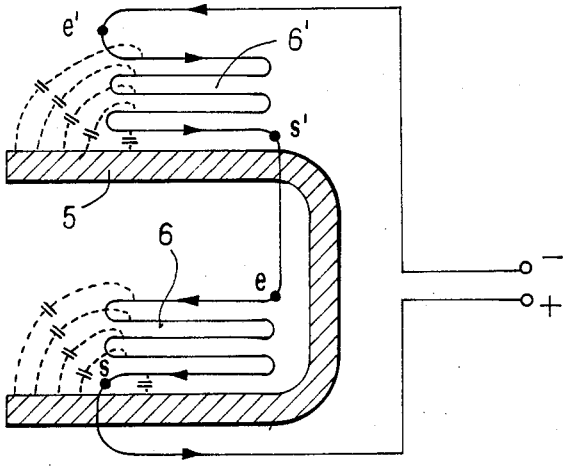
FIG. 2 (PRIOR ART)
FIG. 2 is a schematic diagram of the cartridge of FIG. 1.
Figure 3:
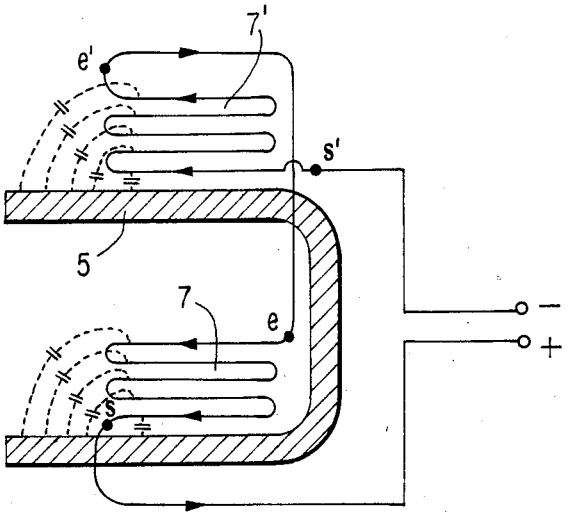
FIG. 3 is a schematic diagram of an illustrative coil configuration of a pickup cartridge in accordance with the present invention.

Referring to FIG. 3, a pair of coils 7 and 7' are respectively wound on the arms of U-shaped yoke 5 to provide a first pair of start terminals s and s' and a second pair of end terminals e and e'. Either of these pairs may be the output and the other pair of terminals are connected to one another. In the particular embodiment of FIG. 3, the start terminals s and s' of wound coils 7 and 7' are connected to the output terminals and the end terminals e and e' are connected together, whereby the distributed electrostatic capacity is balanced between the yoke and coils as seen from both output terminals.

On the other hand, the electrostatic capacity at the terminals e and e' is equal for both coils. And, due to the difference in direction of the electric current in the coils, the noise current induced in the coils by the external magnetic flux passing through the coils is mutually cancelled. As a result, due to the balanced electrostatic capacity along with the improved S/N ratio, transient characteristics and sound reproduction quality are improved. It was thus established that when the respective terminals s and s' at the beginnings of the windings of paired coils 7 and 7' are made outputs and terminals e and e' at the ends of windings are connected to each other, this invention contributes to the improvement in sound reproduction quality of an electromagnetic pickup cartridge. Further, the other combination, in which the beginnings s and s' of the windings are connected to each other and the ends e and e' are connected to the output, is as effective as the particular combination of FIG. 3.

It is to be understood that the above detailed description of the various embodiments of the invention is provided by way of example only. Various details of design and construction may be modified without departing from the true spirit and scope of the invention as set forth in the appended claims.

What is claimed is:

1. In an electromagnetic pickup cartridge having a pair of output terminals and a U-shaped yoke with only a pair of arms and a pair of generator coils respectively wound on said arms where the winding direction of the first of said coils with respect to its associated arm is the reverse of the winding direction of the second of said coils with respect to its associated arm and where the first of said coils has a start terminal s where the coil winding begins and an end terminal e where the winding ends and the second of said coils has a start terminal s' and an end terminal e' to thus provide a first pair of terminals s and s' and a second pair of terminals e and e', the first and second coils being so wound on their respective associated arms that there is a first distributed capacitance between said first coil and its associated arm and a second distributed capacitance between said second coil and its associated arm where said first and second distributed capacitances respectively change in magnitude from the s and s' terminals to the e and e' terminals, the improvement comprising means for connecting one of said pairs of terminals to each other; and means for connecting the other of said pair of terminals respectively to said output terminals to thus form one channel of the pickup cartridge output where said first and second distributed capacitances tend to balance one another as viewed from said output terminals.

2. The improvement as in claim 1 where said start terminals s and s' are connected to each other and said end terminals e and e' are respectively connected to said output terminals.

3. The improvement as in claim 1 where said end terminals e and e' are connected to each other and said start terminals s and s' are respectively connected to said output terminals.

4. The improvement as in claim 1 where said connecting means for connecting said one pair of terminals to each other and said other pair of terminals to the output terminals are wires.

5. The improvement as in claim 4 where said first and second coils are substantially identical.

* * * * *